United States Patent [19]

Bolzoni et al.

[11] Patent Number: 4,961,327

[45] Date of Patent: Oct. 9, 1990

[54] APPARATUS FOR DYEING AND BLEACHING YARNS AND TEXTILE PRODUCTS IN GENERAL

[75] Inventors: Piergiovanni Bolzoni, Stelvio; Marino A. Cutrone, Giornate, both of Italy

[73] Assignee: Cubotex S.r.l., Milan, Italy

[21] Appl. No.: 360,686

[22] Filed: Jun. 2, 1989

[30] Foreign Application Priority Data

Jun. 9, 1988 [IT] Italy ..... 20918 A/88

[51] Int. Cl.[5] ..... D06B 5/00

[52] U.S. Cl. ..... 68/27; 68/184; 68/148; 68/187

[58] Field of Search ..... 68/184, 27, 148, 152, 68/157, 187; 8/151, 158; 354/324, 326, 337, 332

[56] References Cited

U.S. PATENT DOCUMENTS

| | | | |
|---|---|---|---|
| 1,525,085 | 2/1925 | Mitchell et al. | 68/184 |
| 1,824,928 | 9/1931 | Pritchard | 68/184 |
| 2,308,784 | 1/1943 | Silvers | 68/187 X |

FOREIGN PATENT DOCUMENTS

| | | | |
|---|---|---|---|
| 23050 | 11/1908 | United Kingdom | 68/27 |

*Primary Examiner*—Frankie L. Stinson

*Attorney, Agent, or Firm*—Guido Modiano; Albert Josif

[57] ABSTRACT

The present invention relates to an apparatus for dyeing and bleaching yarns and textile products in general, which comprises: a substantially cylindrical treatment tank with a substantially vertical axis and a structure for supporting the items to be treated which can be upwardly extracted from the treatment tank. The support structure comprises a support framework and a plurality of drawers suitable for containing the products to be treated; the drawers are stacked one on top of the other and can be extracted from the support framework, and an impeller provided for circulating a treatment liquid in one direction through the drawers, which are permeable to the treatment liquid, and, in the return direction, through an interspace which is defined between the inner wall of the treatment tank and at least one side portion of the support structure.

8 Claims, 2 Drawing Sheets

APPARATUS FOR DYEING AND BLEACHING YARNS AND TEXTILE PRODUCTS IN GENERAL

BACKGROUND OF THE INVENTION

The present invention relates to an apparatus for dyeing and bleaching yarns and textile products in general, particularly for stockings and pantyhose made of nylon or other materials.

Machines for dyeing or bleaching textile products in general are known; such machines are generally constituted by a tank intended to contain the treatment liquid and in which the products to be treated are placed. Such machines are divided into two categories: machines for treating products which can be crumpled and arranged in a disorderly fashion, and machines for treating products which need to be left carefully folded or laid out.

In machines for treating crumpled products, said products are thrown into cloths or sacks which are permeable to the treatment liquid and said cloths or sacks are inserted in the tank in a more or less orderly manner, filling in the best possible manner all the available spaces so that preferential channels for the flow of liquid are not defined at any point in the volume of products, which would lead to a non-uniform dyeing, usually termed streaking. The tank is filled with water, and the chemical treatment products are added in the various steps of the process; said water, properly termed bath, is moved so as to flow through the products alternately upwards from below and downwards from above.

In machines for treating carefully folded or laid out products, said products, either placed in cloths or sacks or unprotected, are loaded in stackable drawers or containers which are placed in a parallelepipedal tank, and the dyeing bath flows through them substantially as already described for machines for treating crumpled products.

The treatment using drawers, differently from the treatment of crumpled products, maintains the products substantially as they appear when they are loaded, i.e. without wrinkles and well-pressed.

Both treatment methods have been used for a long time, in particularly in sock- and stocking-making factories, despite not being economical mostly due to the high ratio between the weight of the bath and the weight of the products to be treated.

Devices with a cylindrical tank are also known and used for dyeing treatments for textile fibers; said machines are used and conceived to circulate the bath through the textile fibers with a radial circulation. Said devices, in their use for dyeing stockings and pantyhose made of nylon or other materials, force the circulation of the bath in only one direction, since during the dyeing treatment the material bathed in warm water loses volume, facilitating the formation of preferential paths, with the disadvantage of a non-uniform dyeing.

In order to obviate this disadvantage, an apparatus with a cylindrical tank has been provided in which the bath is subjected to an alternated vertical circulation, as in the previously described machines.

Said apparatus, described in the patent application No. 22.353 B/83 filed on July 13, 1983, allows a considerable reduction in power consumption, since it can operate with considerably reduced amounts of bath with respect to the previous machines, with a consequent saving in steam for heating the bath, in water, in chemical treatment products and in electric power.

Said apparatus comprises a cylindrical tank with a vertical axis and a cylindrical perforated container on which the products to be treated are placed, conveniently placed in sacs or cloths permeable to the treatment liquid.

The treatment bath circulates vertically inside the tank, passing alternately through the container of the products in one direction and along an annular space outside the container in the opposite direction.

Said apparatus, though it allows a considerable energy saving with respect to prior devices, can be used only for the dyeing of crumpled products, due to the structure of the product container.

SUMMARY OF THE INVENTION

The aim of the present invention is to provide an apparatus for dyeing or bleaching textile products which allows the treatment of carefully folded or laid out products with a saving in energy which can be compared to that obtainable with an apparatus with a cylindrical tank and with a vertical circulation of the bath, of the type described above.

Within the scope of this aim, an object of the invention is to provide an apparatus with a structure which is simple to manufacture and has a modest cost.

Another object of the invention is to provide an apparatus which can treat products whether they are placed in cloths or sacks or laid out without such protection.

Not least object of the invention is to provide an apparatus which can use existing cylindrical treatment tanks.

This aim as well as these and other objects which will become apparent hereinafter are achieved by an apparatus for dyeing and bleaching yarns and textile products in general, comprising a substantially cylindrical treatment tank with a substantially vertical axis and a structure for supporting the products to be treated which can be upwardly extracted from said treatment tank, characterized in that said support structure comprises a support framework and a plurality of drawers suitable for containing the products to be treated, said drawers being stacked one on top of the other and extractable from said support framework, means being provided to circulate a treatment liquid in one direction through said drawers, which are permeable to said treatment liquid, and in the opposite direction through an interspace defined between the inner wall of said treatment tank and at least one side portion of said support structure.

BRIEF DESCRIPTION OF THE DRAWINGS

Further characteristics and advantages of the invention will become apparent from the description of a preferred but not exclusive embodiment of the apparatus according to the invention, illustrated only by way of non-limitative example in the accompanying drawings, wherein.

DESCRIPTION OF THE PREFERRED EMBODIMENTS

Figure 2:
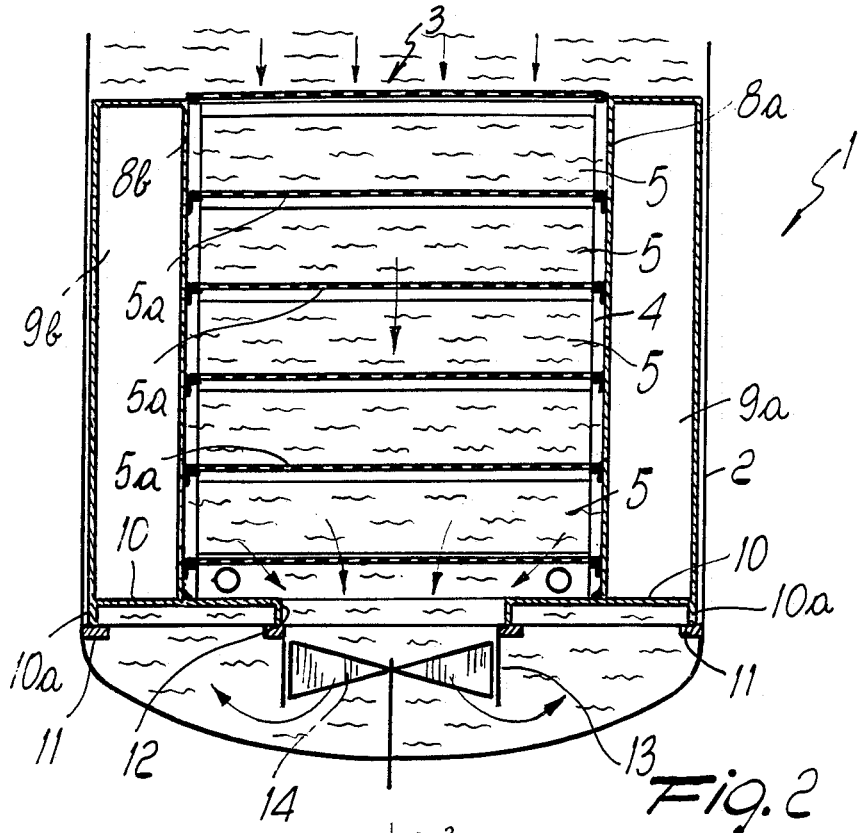
FIG. 2 is a schematic sectional view of FIG. 1 taken along the axis II—II.
Figure 1:
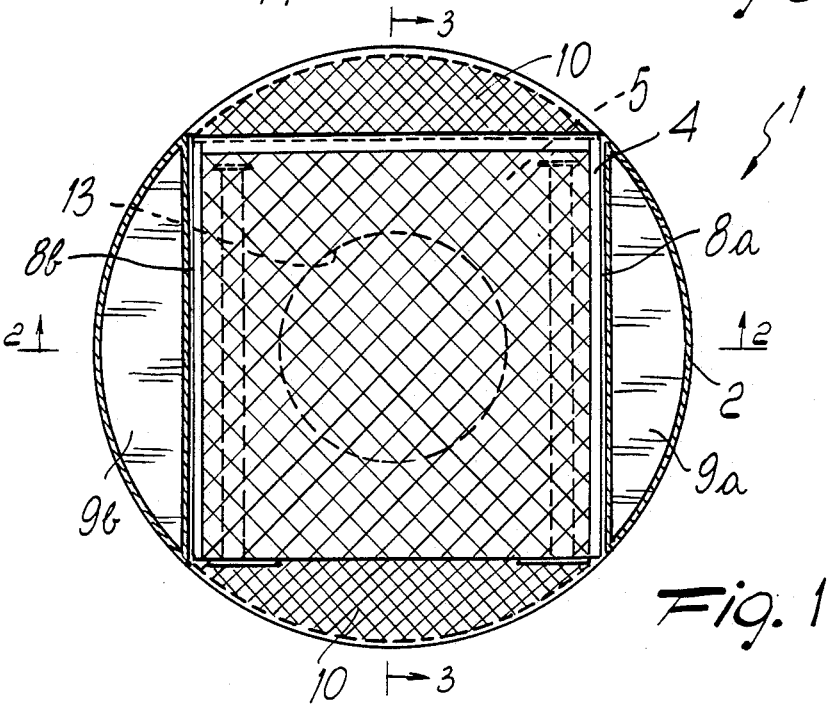
FIG. 1 is a schematic partially sectional top view of the apparatus according to the invention.

With reference to the above-cited figures, the apparatus according to the invention, generally indicated by the reference numeral 1, comprises a cylindrical treatment tank 2 with a vertical axis, intended to contain the treatment liquid, and a support structure 3 in which the products to be treated are placed and which can be upwardly extracted from the treatment tank 2.

According to the invention, the support structure 3 comprises a support framework 4 and a plurality of drawers 5 which are stacked one on top of the other in said support framework 4 and can be extracted from said support framework 4 to load and unload the products.

Each drawer 5 has a perforated bottom 5*a* made for example of wire mesh, and the support framework 4 is internally hollow or has perforated partitions so as to allow the treatment liquid to flow through the drawers along a vertical direction.

The support structure 2 generally has a substantially parallelepipedal configuration with a square base so that two interspaces 7*a* and 7*b* are defined between two opposite lateral faces 6*a* and 6*b* of the support structure and the inner wall of the treatment tank 2 in which it is inserted; said interspaces are used for the vertical circulation of the treatment liquid, as will become more apparent hereinafter.

Means are furthermore advantageously provided, between the other two lateral faces 8*a* and 8*b* of the support structure 3 and the inner wall of the tank 2, to inhibit the passage of the treatment liquid in said region.

Said means are constituted by two box-like bodies 9*a* and 9*b* which are associated tightly against the two lateral faces 8*a* and 8*b* and are in the shape of a cylindrical portion so as to occupy the region comprised between the lateral faces 8*a* and 8*b* and the inner wall of the tank 2. In this manner, since said regions cannot be occupied by the treatment liquid, the amount of treatment liquid required for the dyeing process is reduced.

Obviously, the two box-like bodies 9*a* and 9*b* may be associated with the inner wall of the tank 2 instead of with the support structure 3.

The support framework 4 is downwardly provided with a plate 10 with a circular configuration which has perforations for the passage of the treatment liquid at the interspaces 7*a* and 7*b* and downwardly has feet 10*a* which engage resting means 11 suitably provided in the tank 2 proximate to its bottom. Said resting means may be simply constituted by borders welded to the inner wall of the tank 2.

The plate 10 is centrally provided with a passage 12; when the support structure 3 is arranged inside the tank 2, said passage is located at a duct 13 which is open and arranged vertically proximate to the bottom of the tank 2.

Means for circulating the treatment liquid, for example an impeller 14 of known type, are arranged in said duct 13, which is associated in a known manner with the inner wall of the tank 2; said means generate a current rising through the drawers and a current descending along the interspaces 7*a* and 7*b* or vice versa.

Said drawers 5 are endowed with means to avoid their accidental extraction during the movement of the support structure 3; said means may be constituted for example by a border 15 which protrudes upwardly from each container to retain the overlying container. A locking slider 16 can be provided below the lower container; said slider indirectly locks all the other drawers by locking said lower one.

For the sake of completeness in description, it should be noted that the tank may be provided in a known manner with a lid, which is not illustrated for the sake of simplicity.

The operation of the apparatus according to the invention is as follows.

Figure 3:
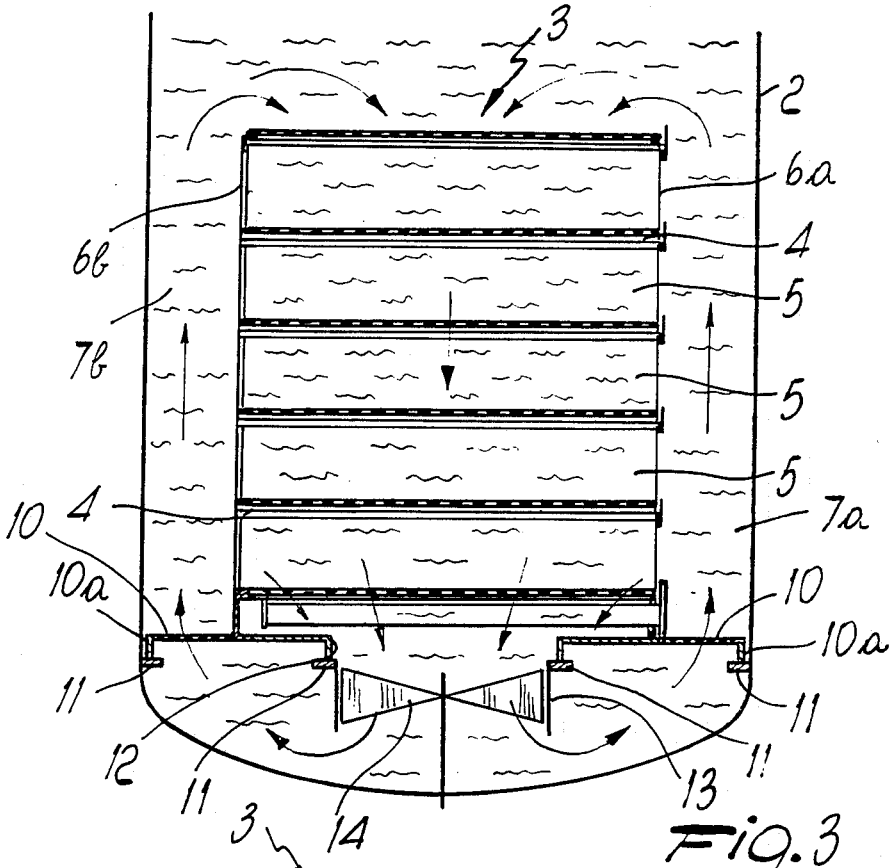
FIG. 3 is a schematic sectional view of FIG. 1 taken along the axis III—III.
Figure 4:
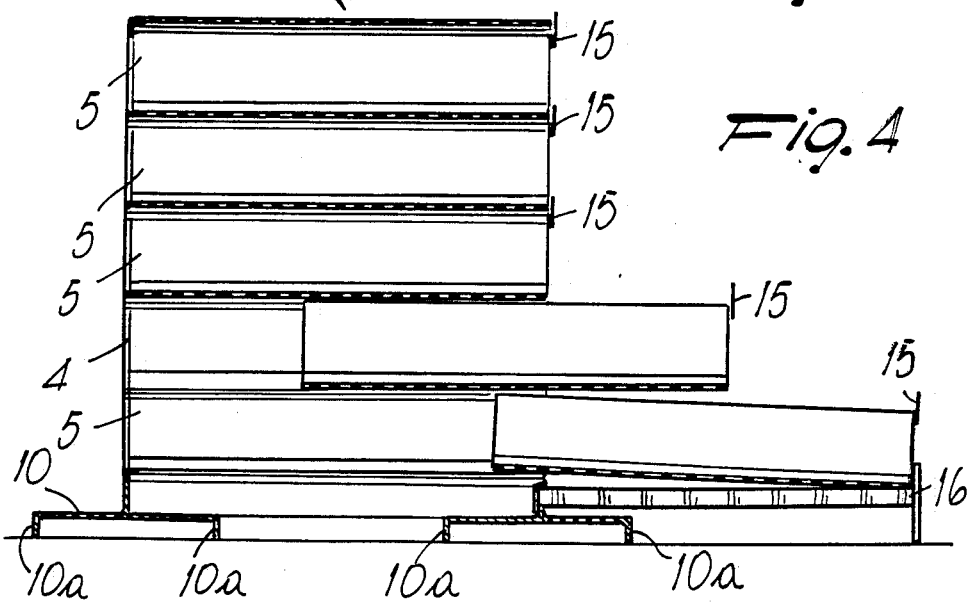
FIG. 4 is a view of the support structure extracted from the treatment tank.

With the structure 3 removed from the tank 2, the products to be treated are loaded by placing them in the drawers 5. The support structure 3 is then placed in the treatment tank 2, and the treatment liquid is introduced in said tank. The actuation of the impeller 14 causes a vertical current within the treatment liquid, which flows upwardly through the drawers 5 and therefore across the products arranged therein and descends through the interspaces 7*a* and 7*b*, or vice versa, as illustrated in FIGS. 2 and 3, according to the direction of actuation of the impeller 14.

After the treatment, the support structure 3 is extracted from the tank 2 and the treated products are unloaded and replaced with other products to be treated.

In practice it has been observed that the apparatus according to the invention fully achieves the intended aim, since though it uses a support structure with drawers for products in a cylindrical tank, it can operate with a modest amount of treatment liquid, allowing the treatment of carefully folded or laid out products with low power consumption.

Another advantage is that the support structure according to the invention can be used for cylindrical tanks which are already commercially available for product as drawers with a cylindrical configuration.

The apparatus thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

We claim:

1. Apparatus for dyeing and bleaching yarns and textile products in general, comprising a substantially cylindrical treatment tank with a substantially vertical axis and a support structure for the products to be treated which can be upwardly extracted from said treatment tank, wherein said support structure comprises a support framework and a plurality of drawers suitable for containing the products to be treated, said drawers being stacked one on top of the other and extractable from said support framework, means being provided for circulating a treatment liquid in one direction through said drawers, which are permeable to said treatment liquid, and, in the opposite direction, through an interspace defined between the inner wall of said treatment tank and at least one lateral portion of said support structure, said support structure furthermore having a substantially parallelepipedal configuration with a square base, two interspaces for the circulation of said treatment liquid being defined between two opposite lateral faces of said support structure and the inner wall of said treatment tank.

2. Apparatus according to claim 1, wherein means are provided between the other two lateral faces of said support structure and the inner wall of said treatment tank to inhibit the flow of the treatment liquid.

3. Apparatus according to claim 2, wherein said means for inhibiting the flow of the treatment liquid are constituted by box-like bodies associated tightly against two opposite faces of said support structure, said box-like bodies substantially occupying the region comprised between two lateral faces of said support structure and the inner wall of said treatment tank.

4. Apparatus according to claim 1, wherein a duct is defined in said treatment tank, said duct being open below said support structure in a central region, said means for circulating the treatment liquid being arranged in said duct, said means generating a current which rises through said drawers and a current which descends through said interspaces or vice versa, means being provided in said treatment tank for resting said support structure to position said support structure above said duct, said support framework being downwardly provided with a plate with a circular configuration with dimensions which are substantially equal to the internal cross-section of said treatment tank, said plate being centrally provided with a passage at said duct and being perforated over the area forming the bottom of said interspaces.

5. Apparatus for dyeing and bleaching yarns and textile products in general, comprising a substantially cylindrical treatment tank with a substantially vertical axis and a support structure for the products to be treated which can be upwardly extracted from said treatment tank, wherein said support structure comprises a support framework and a plurality of drawers suitable for containing the products to be treated, said drawers being stacked one on top of the other and extractable from said support framework, means being provided for circulating a treatment liquid in one direction through said drawers, which are permeable to said treatment liquid, and, in the opposite direction, through an interspace defined between the inner wall of said treatment tank and at least one lateral portion of said support structure, a duct being defined in said treatment tank, said duct being open below said support structure in a central region, said means for circulating the treatment liquid being arranged in said duct, said means generating a current which rises through said drawers and a current which descends through said interspace or vice versa, means being provided in said treatment tank for resting said support structure to position said support structure above said duct, said support framework being downwardly provided with a plate with a circular configuration with dimensions which are substantially equal to the internal cross-section of said treatment tank, said plate being centrally provided with a passage at said duct and being perforated over the area forming the bottom of said interspace.

6. Apparatus according to claim 5, wherein said support structure has a substantially parallelepipedal configuration with a square base, two interspaces for the circulation of said treatment liquid being defined between two opposite lateral faces of said support structure and the inner wall of said treatment tank.

7. Apparatus according to claim 5, wherein said support structure has a substantially parallelepipedal configuration with a square base, two interspaces for the circulation of said treatment liquid being defined between two opposite lateral faces of said support structure and the inner wall of said treatment tank and means being provided between the other two lateral faces of said support structure and the inner wall of said treatment tank to inhibit the flow of the treatment liquid.

8. Apparatus according to claim 7, wherein said means for inhibiting the flow of the treatment liquid are constituted by box-like bodies associated tightly against two opposite faces of said support structure, said box-like bodies substantially occupying the region comprised between two lateral faces of said support structure and the inner wall of said treatment tank.

* * * * *